US008230835B2

(12) United States Patent
Gibson et al.

(10) Patent No.: US 8,230,835 B2
(45) Date of Patent: Jul. 31, 2012

(54) EMERGENCY ENGINE LUBRICATION SYSTEMS AND METHODS

(75) Inventors: Nathan Gibson, Tempe, AZ (US); John Hogan, Gilbert, AZ (US); John D. Robinson, Scottsdale, AZ (US); Mike O'Brien, Goodyear, AZ (US)

(73) Assignee: Honeywell International Inc., Morristown, NJ (US)

( * ) Notice: Subject to any disclaimer, the term of this patent is extended or adjusted under 35 U.S.C. 154(b) by 353 days.

(21) Appl. No.: 12/401,017

(22) Filed: Mar. 10, 2009

(65) Prior Publication Data

US 2010/0229823 A1 Sep. 16, 2010

(51) Int. Cl.
*F01M 11/02* (2006.01)

(52) U.S. Cl. ..... 123/196 R; 123/196 A; 123/196 CP; 123/196 AB; 123/196 S; 123/196 V; 184/104.1; 184/104.2; 184/18; 184/6.22; 184/6.21

(58) Field of Classification Search ..... 123/196 R, 123/196 A, 196 CP, 196 AB, 196 S, 196 V; 92/153; 210/153; 184/18, 104.1, 104.2, 184/104.3, 108, 6.21, 6.22, 6.23, 6.24
See application file for complete search history.

(56) References Cited

U.S. PATENT DOCUMENTS 3,779,345 A 12/1973 Barnes et al.
4,002,224 A 1/1977 Easter
4,153,141 A 5/1979 Methlie
4,284,174 A 8/1981 Salvana et al.
4,373,421 A 2/1983 Camboulives et al.
4,681,189 A * 7/1987 Krisiloff ..... 184/6.13
4,888,947 A 12/1989 Thompson
5,018,601 A 5/1991 Waddington et al.
5,196,746 A 3/1993 McCabria
5,316,737 A * 5/1994 Skelley et al. ..... 422/170
5,526,783 A * 6/1996 Ito et al. ..... 123/196 S
5,526,789 A * 6/1996 Stein et al. ..... 123/432
5,568,842 A * 10/1996 Otani ..... 184/6.22
5,660,358 A 8/1997 Grafwallner et al.
5,829,401 A * 11/1998 Masuda ..... 123/179.25
6,113,676 A * 9/2000 Kumpulainen ..... 96/193
(Continued)

OTHER PUBLICATIONS

Marjii, Sri Harsha M.S. et al.; "Comparison of Deaerator Performance Using Experimental and Numberical Techniques"; Northern Illinois University 2010; pp. 1-8.*

*Primary Examiner* — Noah Kamen
*Assistant Examiner* — Long T Tran
(74) *Attorney, Agent, or Firm* — Ingrassia Fisher & Lorenz, P.C.

(57) ABSTRACT

Emergency lubrication systems and methods for an engine are provided. One system includes a primary lubrication system including a de-aeration oil tank configured to store de-aerated oil until the oil is de-aerated, a first oil supply line configured to provide de-aerated oil to the engine, and a first valve configured to control the flow of oil through the primary lubrication system. The system further includes a secondary lubrication system including a second valve coupled to the de-aeration oil tank and configured to control the flow of oil through the secondary lubrication system, and a second oil supply line coupled to the engine and to the de-aeration oil tank via the second valve. One method includes the steps of detecting a predetermined event in the engine, preventing the aerated oil from entering the primary lubrication system, and using the aerated oil in the secondary lubrication system to lubricate the engine.

19 Claims, 4 Drawing Sheets

U.S. PATENT DOCUMENTS

| | | | | |
|---|---|---|---|---|
| 6,227,221 | B1 | 5/2001 | Schmitz | |
| 6,941,922 | B2 * | 9/2005 | Williams et al. | 123/196 R |
| 7,080,620 | B2 * | 7/2006 | Aronsson et al. | 123/196 R |
| 7,174,997 | B2 | 2/2007 | Sheridan | |
| 7,387,189 | B2 | 6/2008 | James et al. | |
| 2002/0007736 | A1 * | 1/2002 | Hearn et al. | 96/209 |
| 2005/0034924 | A1 * | 2/2005 | James et al. | 184/6.4 |
| 2006/0102133 | A1 * | 5/2006 | Callan | 123/196 R |
| 2008/0116009 | A1 * | 5/2008 | Sheridan et al. | 184/6.4 |
| 2008/0196974 | A1 * | 8/2008 | Galivel | 184/6.4 |

* cited by examiner

EMERGENCY ENGINE LUBRICATION SYSTEMS AND METHODS

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided by the terms of Contract No. W911W6-08-2-0001 awarded by the United States Army.

FIELD OF THE INVENTION

The present invention generally relates to vehicle engines, and more particularly relates to emergency oil systems and methods for a vehicle engine.

BACKGROUND OF THE INVENTION

It is desirable that aircraft, and especially military aircraft, include a secondary lubrication system or "emergency oil system" to operate as a back-up lubrication system in the unlikely event that the primary lubrication system experiences a malfunction or, in the case of military aircraft, that the primary lubrication system is damaged during combat. Contemporary secondary lubrication systems are typically a redundant lubrication system that provides lubrication during the failure of the primary lubrication system. Specifically, the secondary lubrication system typically includes an amount of oil in addition to and separate from the oil for the primary lubrication system for use during operation of the secondary lubrication system. The inclusion of extra oil in the secondary lubrication system adds weight to the aircraft, which added weight is undesirable in aircraft applications.

Accordingly, it is desirable to provide emergency oil systems and methods that use oil from the primary lubrication system during operation. In other words, it is desirable to provide emergency oil systems and methods that reduces or eliminates extra oil. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

Various embodiments provide secondary lubrication systems for an engine including a primary lubrication system having a de-aeration oil tank for storing de-aerated oil. One secondary lubrication system comprises a first valve configured to be coupled to the de-aeration oil tank and configured to control the flow of the de-aerated oil stored in the de-aeration oil tank through the secondary lubrication system, and an oil supply line coupled to the de-aeration oil tank via the first valve and configured to be coupled to the engine.

Other embodiments provide engines for a vehicle. One engine comprises a primary lubrication system and secondary lubrication system coupled to the engine. The primary lubrication system comprises a de-aeration oil tank coupled to the engine and configured to store aerated oil until the oil is de-aerated, a first oil supply line coupled to the de-aeration oil tank and the engine, the first oil supply line configured to provide de-aerated oil to the engine, and a first valve coupled to the de-aeration oil tank and configured to control the flow of oil through the primary lubrication system. The secondary lubrication system comprises a second valve coupled to the de-aeration oil tank and configured to control the flow of oil through the secondary lubrication system, and a second oil supply line coupled to the engine and to the de-aeration oil tank via the second valve.

Methods for lubricating an engine including a primary lubrication system configured to store aerated oil in a de-aeration oil tank and a secondary lubrication system coupled to the de-aeration oil tank are also provided. One method comprises the steps of detecting a predetermined event in the engine, preventing the aerated oil from entering the primary lubrication system, and using the aerated oil in the secondary lubrication system to lubricate the engine.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Various embodiments provide secondary lubrication systems (e.g., emergency oil systems) and methods that use oil from the primary lubrication system during operation. That is, the secondary lubrication systems do not include or reduces the extra oil or lubricant, but rather, use at least a portion of the oil or lubricant in the primary lubrication system during, for example, an emergency loss of oil supply and/or pressure, engine start-up, engine shut-down, and/or during another pre-determined event that may benefit from additional lubrication or cooling.

Figure 1:
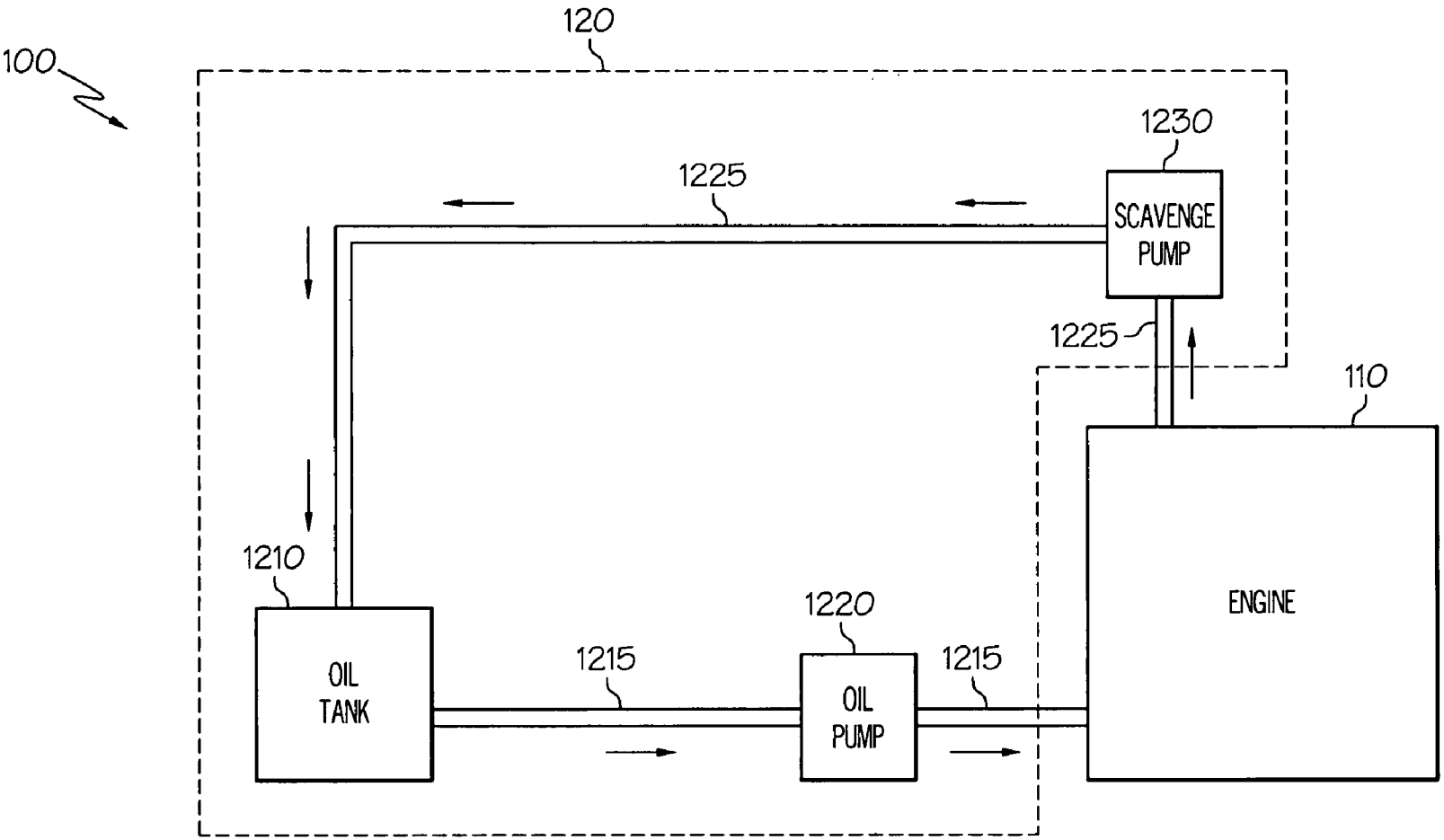
FIG. 1 (PRIOR ART)
FIG. 1 is a block diagram of one example of a prior art engine system including a lubrication system.

Turning now to the figures, FIG. 1 is a block diagram of a prior art engine system 100. At least in the illustrated example, engine system 100 has an engine 110 and a lubrication system 120 for engine 110.

Engine 110 may be configured to power an aircraft (e.g., an airplane, a helicopter, an unmanned or manned aerial vehicle, etc.), a motor vehicle (e.g., a car, a truck, a military vehicle, etc.), a marine vessel (e.g., a boat, a ship, a submarine, etc.), and/or the like. Engine 110 typically includes various moving components (not shown) that need to be lubricated and/or cooled during operation of engine 110.

Lubrication system 120 is configured to provide lubrication and/or cooling to the various moving components within engine 110 using, for example, oil or some other type of lubricant/coolant. At least in the illustrated example of FIG. 1, lubrication system 120 includes an oil tank 1210 connected to an oil pump 1220 and connected to a scavenge pump 1230 (e.g., a return pump) via an oil supply line 1215 and an oil return line 1225, respectively.

Oil tank 1210 is typically configured to store/hold oil that is deemed temporarily "unusable" by engine 110 for normal operation of engine 110. That is, as the oil in lubrication system 120 is used to lubricate and/or cool engine 110, the oil becomes aerated. As one skilled in the art understands, aerated oil does not perform well as a lubricant and/or coolant in engine 110 because aerated oil tends to have a lower overall density, such that there is less mass flow per unit volume. As such, aerated oil does not provide the desired lubrication and/or cooling effect on engine 110. As such, oil tank 1210 is configured to store/hold aerated oil while the air rises out of the oil and the oil becomes substantially de-aerated and deemed suitable for use in lubricating and/or cooling engine 110. Specifically, de-aerated oil tends to settle or accumulate toward the bottom of oil tank 1210 as the oil de-aerates. Once substantially de-aerated, the de-aerated oil is provided to engine 110 via oil pump 1220.

Oil pump 1220 is typically configured to provide the de-aerated oil that has accumulated toward the bottom of oil tank 1210 to the various components of engine 110 that need to be lubricated and/or cooled via oil supply line 1215, which is typically in the form of tubes, channels, and/or other cavities in engine 110. Once engine 110 has used the oil supplied via oil pump 1220 and oil supply line 1215 (i.e., the oil has become aerated and/or heated), the oil is returned to oil tank 1210 via scavenge pump 1230.

Scavenge pump 1230 is typically configured to provide the aerated oil that has been used to lubricate and/or cool the various components in engine 110 to oil tank 1210 via oil return line 1225, which is typically in the form of tubes, channels, and/or other cavities in engine 110. The aerated oil is temporarily stored/held in oil tank 1210 until the oil again becomes substantially de-aerated, accumulates toward the bottom of oil tank 1210, and the lubricating/cooling cycle repeats.

As discussed above, aerated oil is considered unusable for normal operation of an engine; however, in various embodiments of the present invention, aerated oil is deemed usable for an engine in predetermined situations. That is, various embodiments of the present invention use oil that may be considered otherwise unusable to lubricate and/or cool an engine.

Figure 2:
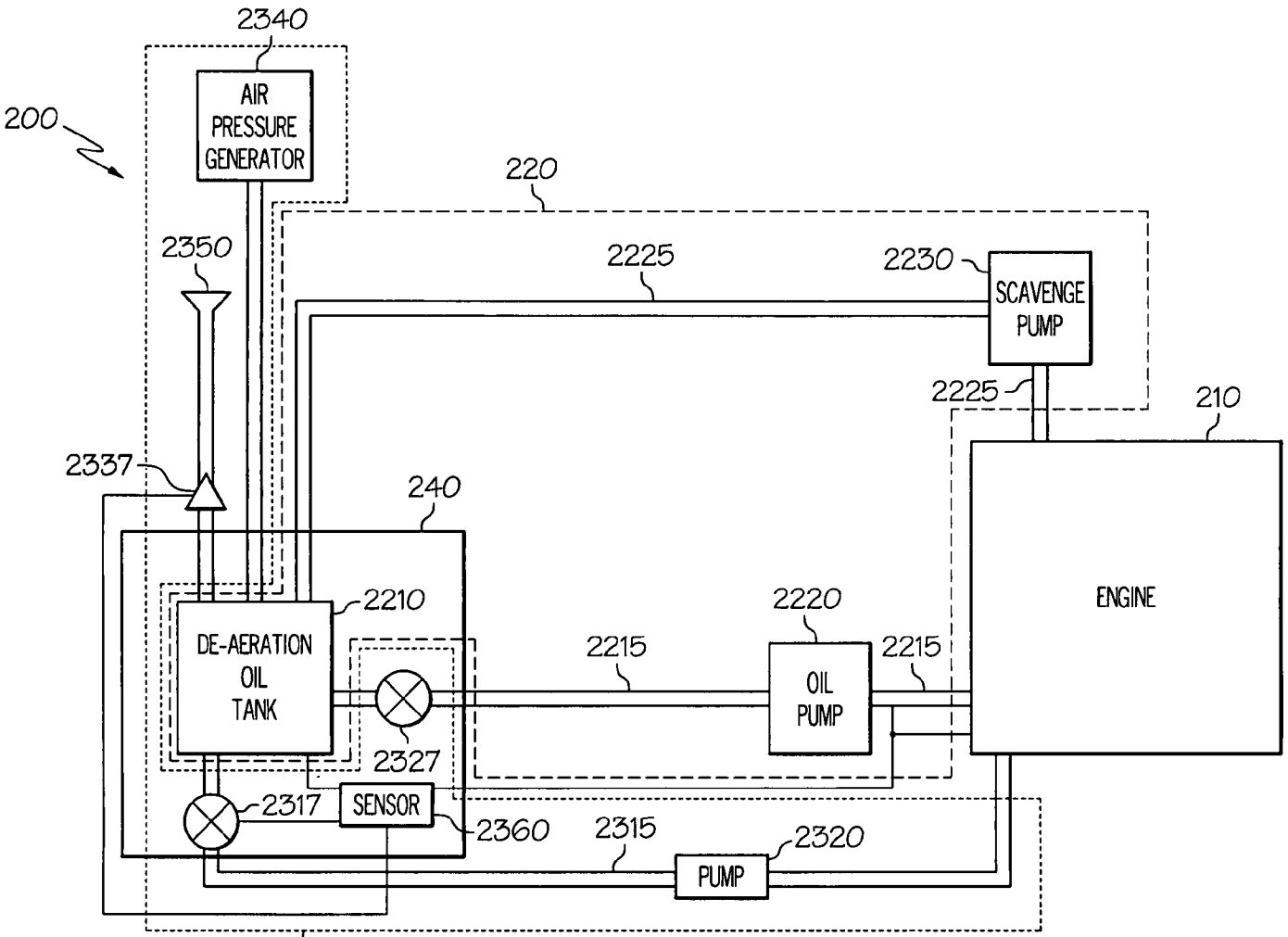
FIG. 2 is a block diagram of one embodiment of an engine system comprising a primary lubrication system and a secondary lubrication system that utilizes oil from the primary lubrication system during operation.

With reference now to FIG. 2, FIG. 2 is a block diagram of one embodiment of an engine system 200. At least in the illustrated embodiment, engine system 200 comprises an engine 210, a primary lubrication system 220, a secondary lubrication system 230, and a shield (e.g., armor) 240 surrounding at least a portion of primary lubrication system 220 and/or secondary lubrication system 230.

Engine 210 may be any engine or power plant capable of powering an aircraft (e.g., an airplane, a helicopter, an unmanned or manned aerial vehicle, etc.), a motor vehicle (e.g., a car, a truck, a military vehicle, etc.), a marine vessel (e.g., a boat, a ship, a submarine, etc.), and/or the like. That is, engine 210 typically includes various moving components (not shown) that need to be lubricated and/or cooled during operation of engine 210.

Primary lubrication system 220 is configured to provide lubrication and/or cooling to the various moving components within engine 210 using, for example, oil or some other type of lubricant/coolant. At least in the illustrated example of FIG. 2, primary lubrication system 220 includes a de-aeration oil tank 2210 connected to an oil pump 2220 and a return or scavenge pump 2230 via an oil supply line 2215 and an oil return line 2225, respectively.

De-aeration oil tank 2210 is configured to store/hold oil at various stages of aeration. That is, de-aeration oil tank 2210 is configured to store/hold aerated oil until the oil becomes substantially de-aerated. In single oil tank configurations, de-aeration oil tank 2210 is the oil tank where oil is stored while de-aerating, and may also be referred to as oil tank 2210. Once substantially de-aerated, the de-aerated oil is provided to oil pump 2220 via a valve 2327, which oil is then provided to engine 210 via oil pump 2220.

Oil pump 2220 is configured to provide the de-aerated oil in de-aeration oil tank 2210 to the various components of engine 210 that need to be lubricated and/or cooled via oil supply line 2215, which may be in the form of tubes, channels, and/or other cavities in engine 210. Once engine 210 has used the oil supplied via oil pump 2220 and oil supply line 2215 (i.e., the oil has become aerated and/or heated), the oil is returned to de-aeration oil tank 2210 via scavenge pump 2230.

Scavenge pump 2230 is configured to provide the aerated oil that has been used to lubricate and/or cool the various components in engine 210 to de-aeration oil tank 2210 via oil return line 2225, which may be in the form of tubes, channels, and/or other cavities in engine 210. The aerated oil is temporarily stored/held in de-aeration oil tank 2210 until the oil becomes substantially de-aerated, accumulates toward the bottom of de-aeration oil tank 2210, and the lubricating/cooling cycle repeats.

Secondary lubrication system 230 (which may be considered an emergency oil system) is configured to provide lubrication and/or cooling to the various moving components within engine 210 in predetermined situations (e.g., when primary lubrication system becomes damaged during combat, in the unlikely event that primary lubrication system 220 experiences a malfunction (e.g., low oil pressure and/or low oil quantity), at start-up of engine 210, at shut-down of engine 210, engine 210 operating at an extreme angle (e.g., attitude) that would impede normal oil supply and scavenge, the vehicle operating engine 210 performing a maneuver that impedes normal function of primary lubrication system 220, and/or the like situations). At least in the embodiment illustrated in FIG. 2, secondary lubrication system 230 includes an oil supply line 2315 coupled to engine 210, a pump 2320 (e.g., an oil pump, a jet pump, etc.) coupled to oil supply line 2315, a de-aeration oil tank 2210 coupled to pump 2320 via a valve 2317 and oil supply line 2315, a valve 2327 coupled between de-aeration oil tank 2210 and oil pump 2220, an air pressure/flow generator 2340 coupled to de-aeration oil tank 2210, a vent 2350 coupled to de-aeration oil tank 2210 via a valve 2357, and one or more sensors/controllers 2360 coupled to engine 210, de-aeration oil tank 2210, primary lubrication system 220, and valves 2317, 2327, and 2337. Valves 2317 and 2327 may be suction valves allowing the suction of de-aerated oil from de-aeration oil tank 2210 through the suction inlets of pumps 2320 or 2220, respectively.

Pump 2320 may be any device and/or system capable of pumping the aerated oil in de-aeration oil tank 2210 to engine 210. That is, pump 2320 is configured to suck the aerated oil out of de-aeration tank 2210 and supply the aerated oil to engine 210. In one embodiment, pump 2320 is an oil pump. In another embodiment, pump 2320 is a jet pump.

Air pressure/flow generator 2340 may be any device and/or system capable of pressurizing de-aeration oil tank 2210. That is, air pressure/flow generator 2340 is configured to push the aerated oil out of de-aeration tank 2210 to engine 210.

To de-pressurize de-aeration oil tank 2210, vent 2350 can be opened, via valve 2337, to expel the pressure within de-aeration oil tank 2210. Although the embodiment illustrated in FIG. 2 includes both pump 2320 and air pressure/flow generator 2340 (and valve 2337), various embodiments contemplate that secondary lubrication system 230 may only include pump 2320 or air pressure/flow generator 2340 (and valve 2337).

Each sensor 2360 is configured to detect the oil pressure and/or oil level of engine 210 and/or primary lubrication system 220. One or more of sensors 2360 is/are configured to switch between operating primary lubrication system 220 and secondary lubrication system 230 depending on the one or more predetermined situations. That is, sensors(s) 2360 is/are configured to control air pressure/flow generator 2340, pump 2320, valve 2317, valve 2327, and/or valve 2337 in accordance with the operational status of primary lubrication system 220 and/or engine 210.

In one embodiment, secondary lubrication system 230 comprises a sensor 2360 configured to detect the oil pressure in engine 210 and/or primary lubrication system 220. In this embodiment, if sensor 2360 detects that the oil pressure in engine 210 and/or primary lubrication system 220 is below a predetermined pressure, sensor 2360 is configured to close valve 2327 and open valve 2317 such that oil stored within de-aeration oil tank 2210 is provided to engine 210 via oil supply line 2315. In addition, sensor 2360 may close valve 2337 (if valve 2337 is open) and turn ON air pressure/flow generator 2340 to pressurize de-aeration oil tank 2210 such that the oil within de-aeration oil tank 2210 is "pushed" through oil supply line 2315. Alternatively or additionally, sensor 2360 may close valve 2337 (if valve 2337 is open) and turn ON pump 2320 to suck the oil out of de-aeration oil tank 2210 and provide the oil to engine 210 via oil supply line 2315.

In another embodiment, secondary lubrication system 230 comprises a sensor 2360 configured to detect the oil level in engine 210 and/or primary lubrication system 220. In this embodiment, if sensor 2360 detects that the oil level in engine 210 and/or primary lubrication system 220 is below a predetermined level, sensor 2360 is configured to close valve 2327 and open valve 2317 such that oil stored within de-aeration oil tank 2210 is provided to engine 210 via oil supply line 2315. In addition, sensor 2360 may close valve 2337 (if valve 2337 is open) and turn ON air pressure/flow generator 2340 to pressurize de-aeration oil tank 2210 such that the oil within de-aeration oil tank 2210 is "pushed" through oil supply line 2315. Alternatively or additionally, sensor 2360 may close valve 2337 (if valve 2337 is open) and turn ON pump 2320 to suck the oil out of de-aeration oil tank 2210 and provide the oil to engine 210 via oil supply line 2315.

In yet another embodiment, secondary lubrication system 230 comprises one or more sensors 2360 configured to detect the oil pressure and oil level in engine 210 and/or primary lubrication system 220. In this embodiment, if the sensor(s) 2360 detect that the oil pressure and/or the oil level in engine 210 and/or primary lubrication system 220 is below a predetermined pressure and/or level, sensor 2360 is configured to close valve 2327 and open valve 2317 such that oil stored within de-aeration oil tank 2210 is provided to engine 210 via oil supply line 2315. In addition, sensor 2360 may close valve 2337 (if valve 2337 is open) and open air pressure/flow generator 2340 to pressurize de-aeration oil tank 2210 such that the oil within de-aeration oil tank 2210 is "pushed" through oil supply line 2315. Alternatively or additionally, sensor 2360 may close valve 2337 (if valve 2337 is open) and turn ON pump 2320 to suck the oil out of de-aeration oil tank 2210 and provide the oil to engine 210 via oil supply line 2315.

In further embodiments of sensor 2360, sensor 2360 is configured to determine the operating status (e.g., start-up and/or shut-down) of engine 210. In one embodiment, if sensor 2360 detects that engine 210 is being started and/or shut down, sensor 2360 is configured to close valve 2327 and open valve 2317 such that oil stored within de-aeration oil tank 2210 is provided to engine 210 via oil supply line 2315. In addition, sensor 2360 may close valve 2337 (if valve 2337 is open) and turn ON air pressure/flow generator 2340 to pressurize de-aeration oil tank 2210 such that the oil within de-aeration oil tank 2210 is "pushed" through oil supply line 2315. Alternatively or additionally, sensor 2360 may close valve 2337 (if valve 2337 is open) and turn ON pump 2320 to suck the oil out of de-aeration oil tank 2210 and provide the oil to engine 210 via oil supply line 2315.

During normal operation of engine 210, sensor 2360 is configured to close valve 2317 and open valve 2327 so that oil is provided to engine 210 via oil supply line 2215. During normal operation, air pressure/flow generator 2340 may be either turned ON or OFF and valve 2337 is closed or open, respectively, depending on if it is desirable to pressurize de-aeration oil tank 2210.

Figure 3:
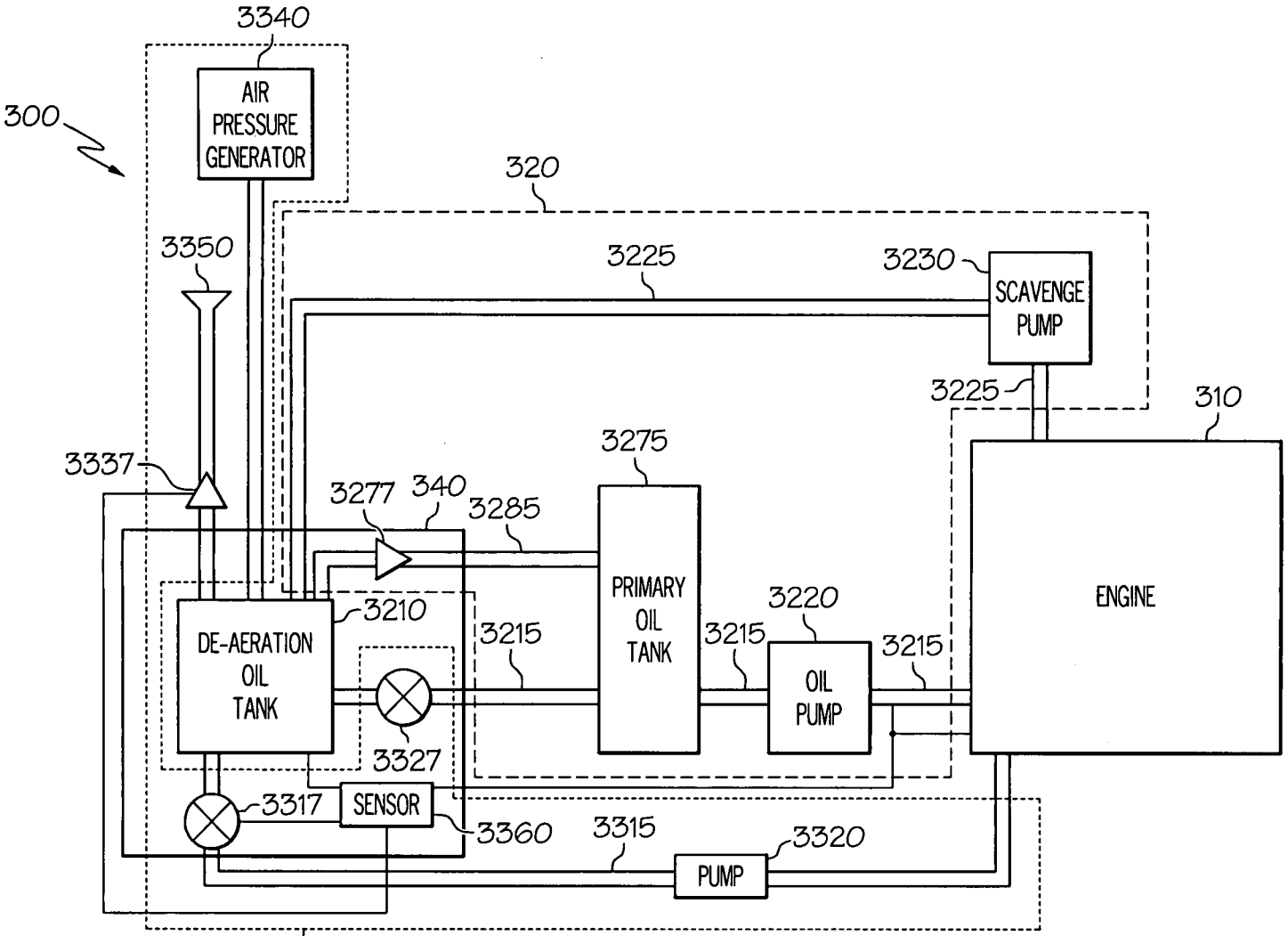
FIG. 3 is a block diagram of another embodiment of an engine system comprising a primary lubrication system and a secondary lubrication system that utilizes oil from the primary lubrication system during operation.

FIG. 3 is a block diagram of one embodiment of an engine system 300. At least in the illustrated embodiment, engine system 300 comprises an engine 310, a primary lubrication system 320, a secondary lubrication system 330, and a shield (e.g., armor) 340 surrounding at least a portion of primary lubrication system 320 and/or secondary lubrication system 330.

Engine 310 may be any engine or power plant capable of powering an aircraft (e.g., an airplane, a helicopter, an unmanned or manned aerial vehicle, etc.), a motor vehicle (e.g., a car, a truck, a military vehicle, etc.), a marine vessel (e.g., a boat, a ship, a submarine, etc.), and/or the like. That is, engine 310 typically includes various moving components (not shown) that need to be lubricated and/or cooled during operation of engine 310.

Primary lubrication system 320 is configured to provide lubrication and/or cooling to the various moving components within engine 310 using, for example, oil or some other type of lubricant/coolant. At least in the illustrated example of FIG. 3, primary lubrication system 320 includes a de-aeration oil tank 3210 connected to a primary oil tank 3275 and a return or scavenge pump 3230 via an oil supply line 3215 and an oil return line 3225, respectively. Primary lubrication system 320 further includes an oil pump coupled to primary oil tank 3275 and engine 310

De-aeration oil tank 3210 is configured to store/hold oil at various stages of aeration. That is, de-aeration oil tank 3210 is configured to store/hold aerated oil until the oil becomes substantially de-aerated. Once substantially de-aerated, the de-aerated oil is provided to primary oil tank 3275 via a valve 3327.

Primary oil tank 3275 is configured to store/hold de-aerated oil. Primary oil tank 3275 also includes an oil return line 3285 configured to return excess oil to de-aeration oil tank 3210 via a valve 3277 (e.g., a one-way valve), which is also configured to prevent aerated oil stored in de-aeration oil tank 3210 from entering primary oil tank 3275. When needed by engine 310, the aerated oil stored in primary oil tank 3275 is provided to engine 310 via oil pump 3220.

Oil pump 3220 is configured to provide the de-aerated oil in de-aeration oil tank 3210 to the various components of engine 310 that need to be lubricated and/or cooled via oil supply line 3215, which may be in the form of tubes, channels, and/or other cavities in engine 310. Once engine 310 has used the oil supplied via oil pump 3220 and oil supply line 3215 (i.e., the oil has become aerated and/or heated), the oil is returned to de-aeration oil tank 3210 via scavenge pump 3230.

Scavenge pump 3230 is configured to provide the aerated oil that has been used to lubricate and/or cool the various components in engine 310 to de-aeration oil tank 3210 via oil return line 3225, which may be in the form of tubes, channels, and/or other cavities in engine 310. The aerated oil is temporarily stored/held in de-aeration oil tank 3210 until the oil again becomes substantially de-aerated, accumulates toward the bottom of de-aeration oil tank 3210, and the lubricating/cooling cycle repeats.

Secondary lubrication system 330 (which may be considered an emergency oil system) is configured to provide lubrication and/or cooling to the various moving components within engine 310 in predetermined situations (e.g., when primary lubrication system becomes damaged during combat, in the unlikely event that primary lubrication system 320 experiences a malfunction (e.g., low oil pressure and/or low oil quantity), at start-up of engine 310, at shut-down of engine 310, and/or the like situations).

At least in the embodiment illustrated in FIG. 3, secondary lubrication system 330 includes an oil supply line 3315 coupled to engine 310, a pump 3320 coupled to oil supply line 3315, a de-aeration oil tank 3210 coupled to pump 3320 via a valve 3317 and oil supply line 3315, a valve 3327 coupled between de-aeration oil tank 3210 and primary oil tank 3275, an air pressure/flow generator 3340 coupled to de-aeration oil tank 3210, a vent 3350 coupled to de-aeration oil tank 3210 via a valve 3357, and one or more sensors/controllers 3360 coupled to engine 310, de-aeration oil tank 3210, primary lubrication system 320, and valves 3317, 3327, and 3337.

Pump 3320 may be any device and/or system capable of pumping the aerated oil in de-aeration oil tank 3210 to engine 310. That is, pump 3320 is configured to suck the aerated oil out of de-aeration tank 3210 and supply the aerated oil to engine 310. In one embodiment, pump 3320 is an oil pump. In another embodiment, pump 3320 is a jet pump. Valves 3327 and 3317 may be suction valves allowing pumps 3220 and 3320, respectively to take suction on de-aeration oil tank 3210.

Air pressure/flow generator 3340 may be any device and/or system capable of pressurizing de-aeration oil tank 3210. That is, air pressure/flow generator 3340 is configured to push the aerated oil out of de-aeration tank 3210 to engine 310.

To de-pressurize de-aeration oil tank 3210, vent 3350 can be opened, via valve 3337, to expel the pressure within de-aeration oil tank 3210. Although the embodiment illustrated in FIG. 3 includes both pump 3320 and air pressure/flow generator 3340 (and valve 3337), various embodiments contemplate that secondary lubrication system 330 may only include pump 3320 or air pressure/flow generator 3340 (and valve 3337).

Each sensor 3360 is configured to detect the oil pressure and/or oil level of engine 310 and/or primary lubrication system 320. One or more of sensors 3360 is/are configured to switch between operating primary lubrication system 320 and secondary lubrication system 330 depending on the one or more predetermined situations. That is, sensors(s) 3360 are configured to control air pressure/flow generator 3340, pump 3320, valve 3317, valve 3327, and/or valve 3337 in accordance with the operational status of primary lubrication system 320 and/or engine 310.

In one embodiment, secondary lubrication system 330 comprises a sensor 3360 configured to detect the oil pressure in engine 310 and/or primary lubrication system 320. In this embodiment, if sensor 3360 detects that the oil pressure in engine 310 and/or primary lubrication system 320 is below a predetermined pressure, sensor 3360 is configured to close valve 3327 and open valve 3317 such that oil stored within de-aeration oil tank 3210 is provided to engine 310 via oil supply line 3315. In addition, sensor 3360 may close valve 3337 (if valve 3337 is open) and turn ON air pressure/flow generator 3340 to pressurize de-aeration oil tank 3210 such that the oil within de-aeration oil tank 3210 is "pushed" through oil supply line 3315. Alternatively or additionally, sensor 3360 may close valve 3337 (if valve 3337 is open) and turn ON pump 3320 to suck the oil out of de-aeration oil tank 3210 and provide the oil to engine 310 via oil supply line 3315.

In another embodiment, secondary lubrication system 330 comprises a sensor 3360 configured to detect the oil level in engine 310 and/or primary lubrication system 320. In this embodiment, if sensor 3360 detects that the oil level in engine 310 and/or primary lubrication system 320 is below a predetermined level, sensor 3360 is configured to close valve 3327 and open valve 3317 such that oil stored within de-aeration oil tank 3210 is provided to engine 310 via oil supply line 3315. In addition, sensor 3360 may close valve 3337 (if valve 3337 is open) and turn ON air pressure/flow generator 3340 to pressurize de-aeration oil tank 3210 such that the oil within de-aeration oil tank 3210 is "pushed" through oil supply line 3315. Alternatively or additionally, sensor 3360 may close valve 3337 (if valve 3337 is open) and turn ON pump 3320 to suck the oil out of de-aeration oil tank 3210 and provide the oil to engine 310 via oil supply line 3315.

In yet another embodiment, secondary lubrication system 330 comprises one or more sensors 3360 configured to detect the oil pressure and oil level in engine 310 and/or primary lubrication system 320. In this embodiment, if the sensor(s) 3360 detect that the oil pressure and/or the oil level in engine 310 and/or primary lubrication system 320 is below a predetermined pressure and/or level, sensor 3360 is configured to close valve 3327 and open valve 3317 such that oil stored within de-aeration oil tank 3210 is provided to engine 310 via oil supply line 3315. In addition, sensor 3360 may close valve 3337 (if valve 3337 is open) and turn ON air pressure/flow generator 3340 to pressurize de-aeration oil tank 3210 such that the oil within de-aeration oil tank 3210 is "pushed" through oil supply line 3315. Alternatively or additionally, sensor 3360 may close valve 3337 (if valve 3337 is open) and turn ON pump 3320 to suck the oil out of de-aeration oil tank 3210 and provide the oil to engine 310 via oil supply line 3315.

In further embodiments of sensor 3360, sensor 3360 is configured to determine the operating status (e.g., start-up and/or shut-down) of engine 310. In one embodiment, if sensor 3360 detects that engine 310 is being started and/or shut down, sensor 3360 is configured to close valve 3327 and open valve 3317 such that oil stored within de-aeration oil tank 3210 is provided to engine 310 via oil supply line 3315. In addition, sensor 3360 may close valve 3337 (if valve 3337 is open) and turn ON air pressure/flow generator 3340 to pressurize de-aeration oil tank 3210 such that the oil within de-aeration oil tank 3210 is "pushed" through oil supply line 3315. Alternatively or additionally, sensor 3360 may close valve 3337 (if valve 2337 is open) and turn ON pump 3320 to suck the oil out of de-aeration oil tank 3210 and provide the oil to engine 310 via oil supply line 3315.

During normal operation of engine 310, sensor 3360 is configured to close valve 3317 and open valve 3327 so that oil is provided to engine 310 via oil supply line 3215. During normal operation, air pressure/flow generator 3340 may be either turned ON or OFF and valve 3337 is closed or open, respectively, depending on if it is desirable to pressurize de-aeration oil tank 3210.

Figure 4:
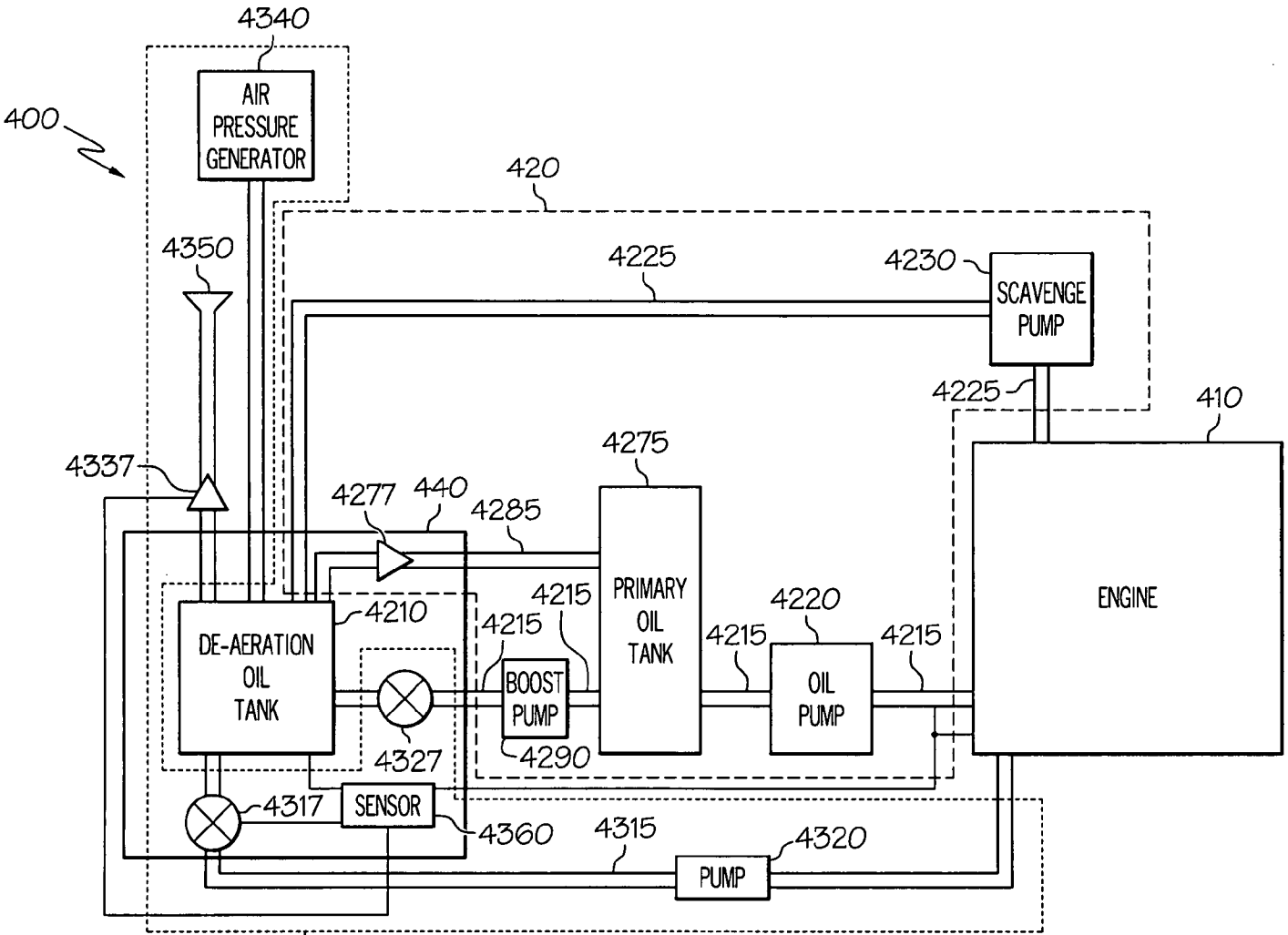
FIG. 4 is a block diagram of yet another embodiment of an engine system comprising a primary lubrication system and a secondary lubrication system that utilizes oil from the primary lubrication system during operation.

FIG. 4 is a block diagram of one embodiment of an engine system 400. At least in the illustrated embodiment, engine system 400 comprises an engine 410, a primary lubrication system 420, a secondary lubrication system 430, and a shield (e.g., armor) 440 surrounding at least a portion of primary lubrication system 420 and/or secondary lubrication system 430.

Engine 410 may be any engine or power plant capable of powering an aircraft (e.g., an airplane, a helicopter, an unmanned or manned aerial vehicle, etc.), a motor vehicle (e.g., a car, a truck, a military vehicle, etc.), a marine vessel (e.g., a boat, a ship, a submarine, etc.), and/or the like. That is, engine 410 typically includes various moving components (not shown) that need to be lubricated and/or cooled during operation of engine 410.

Primary lubrication system 420 is configured to provide lubrication and/or cooling to the various moving components within engine 410 using, for example, oil or some other type of lubricant/coolant. At least in the illustrated example of FIG. 4, primary lubrication system 420 includes a de-aeration oil tank 4210 connected to a primary oil tank 4275 and a return or scavenge pump 4230 via an oil supply line 4215 and an oil return line 4225, respectively. Primary lubrication system 420 further includes an oil pump coupled to primary oil tank 4275 and engine 410

De-aeration oil tank 4210 is configured to store/hold oil at various stages of aeration. That is, de-aeration oil tank 4210 is configured to store/hold aerated oil until the oil becomes substantially de-aerated. Once substantially de-aerated, the de-aerated oil is provided to primary oil tank 4275 via a valve 4327 and a boost pump 4290, which is configured to pressurize primary oil tank 4275, along oil supply line 4215.

Primary oil tank 4275 is configured to store/hold de-aerated oil. Primary oil tank 4275 also includes an oil return line 4285 configured to return excess oil to de-aeration oil tank 4210 via a valve 4277 (e.g., a one-way valve), which is also configured to prevent aerated oil stored in de-aeration oil tank 4210 from entering primary oil tank 4275. When needed by engine 410, the aerated oil stored in primary oil tank 4275 is provided to engine 410 via oil pump 4220.

Oil pump 4220 is configured to provide the de-aerated oil in primary oil tank 4275 to the various components of engine 410 that need to be lubricated and/or cooled via oil supply line 4215, which may be in the form of tubes, channels, and/or other cavities in engine 410. Once engine 410 has used the oil supplied via oil pump 4220 and oil supply line 4215 (i.e., the oil has become aerated and/or heated), the oil is returned to de-aeration oil tank 4210 via scavenge pump 4230.

Scavenge pump 4230 is configured to provide the aerated oil that has been used to lubricate and/or cool the various components in engine 410 to de-aeration oil tank 4210 via oil return line 4225, which may be in the form of tubes, channels, and/or other cavities in engine 410. The aerated oil is temporarily stored/held in de-aeration oil tank 4210 until the oil again becomes substantially de-aerated, accumulates toward the bottom of de-aeration oil tank 4210, and the lubricating/cooling cycle repeats.

Secondary lubrication system 430 (which may be considered an emergency oil system) is configured to provide lubrication and/or cooling to the various moving components within engine 410 in predetermined situations (e.g., when primary lubrication system becomes damaged during combat, in the unlikely event that primary lubrication system 420 experiences a malfunction (e.g., low oil pressure and/or low oil quantity), at start-up of engine 410, at shut-down of engine 410, and/or the like situations). At least in the embodiment illustrated in FIG. 4, secondary lubrication system 430 includes an oil supply line 4315 coupled to engine 410, a pump 4320 coupled to oil supply line 4315, a de-aeration oil tank 4210 coupled to pump 4320 via a valve 4317 and oil supply line 4315, a valve 4327 coupled between de-aeration oil tank 4210 and primary oil tank 4275, an air pressure/flow generator 4340 coupled to de-aeration oil tank 4210, a vent 4350 coupled to de-aeration oil tank 4210 via a valve 4357, and one or more sensors/controllers 4360 coupled to engine 410, de-aeration oil tank 4210, primary lubrication system 420, and valves 4317, 4327, and 4337.

Pump 4320 may be any device and/or system capable of pumping the aerated oil in de-aeration oil tank 4210 to engine 410. That is, pump 4320 is configured to suck the aerated oil out of de-aeration tank 4210 and supply the aerated oil to engine 410. In one embodiment, pump 4320 is an oil pump. In another embodiment, pump 4320 is a jet pump.

Air pressure/flow generator 4340 may be any device and/or system capable of pressurizing de-aeration oil tank 4210. That is, air pressure/flow generator 4340 is configured to push the aerated oil out of de-aeration tank 4210 to engine 410.

To de-pressurize de-aeration oil tank 4210, vent 4350 can be opened, via valve 4337, to expel the pressure within de-aeration oil tank 4210. Although the embodiment illustrated in FIG. 4 includes both pump 4320 and air pressure/flow generator 4340 (and valve 4337), various embodiments contemplate that secondary lubrication system 430 may only include pump 4320 or air pressure/flow generator 4340 (and valve 4337).

Each sensor 4360 is configured to detect the oil pressure and/or oil level of engine 410 and/or primary lubrication system 420. One or more of sensors 4360 is/are configured to switch between operating primary lubrication system 420 and secondary lubrication system 430 depending on the one or more predetermined situations. That is, sensors(s) 4360 are configured to control air pressure/flow generator 4340, pump 4320, valve 4317, valve 4327, and/or valve 4337 in accordance with the operational status of primary lubrication system 420 and/or engine 410.

In one embodiment, secondary lubrication system 430 comprises a sensor 4360 configured to detect the oil pressure in engine 410 and/or primary lubrication system 420. In this embodiment, if sensor 4360 detects that the oil pressure in engine 410 and/or primary lubrication system 420 is below a predetermined pressure, sensor 4360 is configured to close valve 4327 and open valve 4317 such that oil stored within de-aeration oil tank 4210 is provided to engine 410 via oil supply line 4315. In addition, sensor 4360 may close valve 4337 (if valve 4337 is open) and turn ON air pressure/flow generator 4340 to pressurize de-aeration oil tank 4210 such that the oil within de-aeration oil tank 4210 is "pushed" through oil supply line 4315. Alternatively or additionally, sensor 4360 may close valve 4337 (if valve 4337 is open) and turn ON pump 4320 to suck the oil out of de-aeration oil tank 4210 and provide the oil to engine 410 via oil supply line 4315.

In another embodiment, secondary lubrication system 430 comprises a sensor 4360 configured to detect the oil level in engine 410 and/or primary lubrication system 420. In this embodiment, if sensor 4360 detects that the oil level in engine 410 and/or primary lubrication system 420 is below a predetermined level, sensor 4360 is configured to close valve 4327 and open valve 4317 such that oil stored within de-aeration oil tank 4210 is provided to engine 410 via oil supply line 4315.

In addition, sensor 4360 may close valve 4337 (if valve 4337 is open) and turn ON air pressure/flow generator 4340 to pressurize de-aeration oil tank 4210 such that the oil within de-aeration oil tank 4210 is "pushed" through oil supply line 4315. Alternatively or additionally, sensor 4360 may close valve 4337 (if valve 4337 is open) and turn ON pump 4320 to suck the oil out of de-aeration oil tank 4210 and provide the oil to engine 410 via oil supply line 4315.

In yet another embodiment, secondary lubrication system 430 comprises one or more sensors 4360 configured to detect the oil pressure and oil level in engine 410 and/or primary lubrication system 420. In this embodiment, if the sensor(s) 4360 detect that the oil pressure and/or the oil level in engine 410 and/or primary lubrication system 420 is below a predetermined pressure and/or level, sensor 4360 is configured to close valve 4327 and open valve 4317 such that oil stored within de-aeration oil tank 4210 is provided to engine 410 via oil supply line 4315. In addition, sensor 4360 may close valve 4337 (if valve 4337 is open) and turn ON air pressure/flow generator 4340 to pressurize de-aeration oil tank 4210 such that the oil within de-aeration oil tank 4210 is "pushed" through oil supply line 4315. Alternatively or additionally, sensor 4360 may close valve 4337 (if valve 4337 is open) and turn ON pump 4320 to suck the oil out of de-aeration oil tank 4210 and provide the oil to engine 410 via oil supply line 4315.

In further embodiments of sensor 4360, sensor 4360 is configured to determine the operating status (e.g., start-up and/or shut-down) of engine 410. In one embodiment, if sensor 4360 detects that engine 410 is being started and/or shut down, sensor 4360 is configured to close valve 4327 and open valve 4317 such that oil stored within de-aeration oil tank 4210 is provided to engine 410 via oil supply line 4315. In addition, sensor 4360 may close valve 4337 (if valve 4337 is open) and turn ON air pressure/flow generator 4340 to pressurize de-aeration oil tank 4210 such that the oil within de-aeration oil tank 4210 is "pushed" through oil supply line 4315. Alternatively or additionally, sensor 4360 may close valve 4337 (if valve 4337 is open) and turn ON pump 4320 to suck the oil out of de-aeration oil tank 4210 and provide the oil to engine 410 via oil supply line 4315.

During normal operation of engine 410, sensor 4360 is configured to close valve 4317 and open valve 4327 so that oil is provided to engine 410 via oil supply line 4215. During normal operation, air pressure/flow generator 4340 may be either turned ON or OFF and valve 4337 is closed or open, respectively, depending on if it is desirable to pressurize de-aeration oil tank 4210.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A secondary lubrication system for an engine including a primary lubrication system having a de-aeration oil tank for storing de-aerated oil, comprising:

a first suction valve configured to be coupled to the de-aeration oil tank and configured to control the flow of the de-aerated oil stored in the de-aeration oil tank through the secondary lubrication system;

a second suction valve coupled to the de-aeration oil tank and configured to control the flow of oil through the primary lubrication system; and an oil supply line coupled to the de-aeration oil tank via the first suction valve and configured to be coupled to the engine.

2. The secondary lubrication system of claim 1, further comprising a controller coupled to the first suction valve and the second suction valve, the controller configured to control the first and second suction valves such that:

the first suction valve is closed and the second valve is open during operation of the primary lubrication system, and the first suction valve is open and the second suction valve is closed during operation of the secondary lubrication system, during start-up of the engine, or during shut-down of the engine.

3. The secondary lubrication system of claim 1, further comprising:

a vent coupled to the de-aeration oil tank; and a third valve coupled between the vent and the de-aeration oil tank.

4. The secondary lubrication system of claim 1, further comprising:

an air pressure/flow generator coupled to the de-aeration oil tank; and a third valve coupled between the air pressure/flow generator and the de-aeration oil tank.

5. An engine for a vehicle, comprising:

a primary lubrication system coupled to the engine, comprising:

a de-aeration oil tank coupled to the engine and configured to store aerated oil until the oil is de-aerated, a first oil supply line coupled to the de-aeration oil tank and the engine, the first oil supply line configured to provide de-aerated oil to the engine, and a first suction valve coupled to the de-aeration oil tank and configured to control the flow of oil through the primary lubrication system; and a secondary lubrication system coupled to the engine, comprising:

a second suction valve coupled to the de-aeration oil tank and configured to control the flow of oil through the secondary lubrication system, and a second oil supply line coupled to the engine and to the de-aeration oil tank via the second suction valve.

6. The engine of claim 5, further comprising:

a vent coupled to the de-aeration oil tank; and a third valve coupled between the vent and the de-aeration oil tank.

7. The engine of claim 5, further comprising a controller coupled to the first suction valve and the second suction valve, the controller configured to control the first and second suction valves such that:

the first suction valve is open and the second suction valve is closed during operation of the primary lubrication system, and the first suction valve is closed and the second suction valve is open during operation of the secondary lubrication system, during start-up of the engine, or during shut-down of the engine.

8. The engine of claim 5, further comprising an oil pressure sensor coupled to the primary lubrication system, the oil pressure sensor configured to:

close the first suction valve if the oil pressure is below a predetermined threshold pressure, and open the second suction valve if the oil pressure is below the predetermined threshold pressure.

9. The engine of claim 5, further comprising an oil level sensor coupled to the primary lubrication system, the oil level sensor configured to:

close the first suction valve if the oil level is below a predetermined threshold level, and open the second suction valve if the oil pressure is below the predetermined threshold level.

10. The engine of claim 5, further comprising:

an air pressure/flow generator coupled to the de-aeration oil tank; and a third valve coupled between the air pressure/flow generator and the de-aeration oil tank.

11. The engine of claim 10, further comprising an oil pressure sensor coupled to the primary lubrication system, the oil pressure sensor configured to:

close the first suction valve if the oil pressure is below a predetermined threshold pressure, open the second suction valve if the oil pressure is below the predetermined threshold pressure, and open the third valve if the oil pressure is below the predetermined threshold pressure.

12. The engine of claim 10, further comprising an oil level sensor coupled to the primary lubrication system, the oil level sensor configured to:

close the first suction valve if the oil level is below a predetermined threshold level, open the second suction valve if the oil pressure is below the predetermined threshold level, and open the third valve if the oil pressure is below the predetermined threshold level.

13. The engine of claim 5, further comprising a primary tank coupled between the first suction valve and the first oil supply line, the primary tank configured to store de-aerated oil.

14. The engine of claim 13, further comprising:

an oil return line coupled to the primary tank and the de-aeration oil tank; and a third valve coupled between the primary tank and the de-aeration oil tank.

15. The engine of claim 5, further comprising:

a primary tank coupled between the first valve and the first oil supply line, the primary tank configured to store de-aerated oil; and a boost pump coupled between the first valve and the primary tank, the boost pump configured to pressurize the primary tank.

16. The engine of claim 15, further comprising:

an oil return line coupled to the primary tank and the de-aeration oil tank; and a third valve coupled between the primary tank and the de-aeration oil tank.

17. The engine of claim 5, further comprising a shield surrounding the first valve, the second valve, and at least a portion of the de-aeration oil tank.

18. A method for lubricating an engine including a primary lubrication system configured to store de-aerated oil in a de-aeration oil tank and a secondary lubrication system coupled to the de-aeration oil tank, the method comprising the steps of:

detecting a predetermined event in the engine;

preventing the de-aerated oil from entering the primary lubrication system; and using the de-aerated oil in the secondary lubrication system to lubricate the engine.

19. The method of claim 18, wherein detecting the predetermined event comprises detecting engine start-up, engine shut-down, a loss of oil pressure in the engine, or a loss of oil level in the engine.

* * * * *